US005540004A

United States Patent [19]

Patterson et al.

[11] Patent Number: 5,540,004

[45] Date of Patent: Jul. 30, 1996

[54] APPARATUS FOR REMOVING SCRAPING A GROUND SURFACE

[75] Inventors: Roger L. Patterson, Manitoba; Gilbert E. Coté, deceased, late of Alberta, Canada, by Aline Cote, executor

[73] Assignee: Tessier Resources Ltd., Winnipeg, Canada

[21] Appl. No.: 235,946

[22] Filed: May 2, 1994

[30] Foreign Application Priority Data

May 3, 1993 [CA] Canada ..... 2095399

[51] Int. Cl.[6] ..... E01H 5/09

[52] U.S. Cl. ..... 37/244; 37/219; 37/223; 172/540; 172/532; 15/55

[58] Field of Search ..... 37/244, 248, 219, 37/223, 403; 172/540, 554, 532, 45, 122, 123; 15/53.2, 32, 34, 366, 230, 55, 159

[56] References Cited

U.S. PATENT DOCUMENTS

| | | | |
|---|---|---|---|
| 977,724 | 12/1910 | Friedman | 37/244 X |
| 1,629,321 | 5/1927 | Simpson | 37/244 X |
| 1,836,116 | 12/1931 | Hayen | 37/248 |
| 2,156,066 | 4/1939 | Royer et al. | 37/244 X |
| 2,162,434 | 6/1939 | Hillyer | 172/45 |
| 2,171,075 | 8/1939 | Blazier | 15/79 |
| 2,197,549 | 4/1940 | Hargrave et al. | 37/244 X |
| 2,789,804 | 4/1957 | Toulmin, Jr. | 37/244 X |
| 2,902,099 | 9/1959 | Yafjack | 172/554 |
| 2,986,841 | 6/1961 | MacDonald | 172/45 |
| 2,994,896 | 8/1961 | Lopes | 37/244 X |
| 3,005,274 | 10/1961 | Kershaw | 15/55 X |
| 3,167,899 | 2/1965 | Best | 172/45 |
| 3,278,966 | 10/1966 | Godfrey | 15/198 |
| 3,297,096 | 1/1967 | Wooldridge | 37/244 X |
| 3,314,095 | 4/1967 | Prange | 15/104.2 |
| 3,533,121 | 10/1970 | Kershaw | 15/55 |
| 3,562,933 | 2/1971 | Hanneman et al. | 37/248 |
| 3,649,984 | 3/1972 | Kershaw et al. | 15/55 X |
| 3,735,510 | 5/1973 | Godfrey et al. | 37/248 |
| 4,144,610 | 3/1979 | Moore et al. | 15/159 A |
| 4,192,387 | 3/1980 | Stinson | 172/554 |
| 4,282,666 | 8/1981 | Brandt | 37/244 X |
| 4,406,114 | 9/1983 | Lanier et al. | 57/7 |
| 4,619,061 | 10/1986 | Swanson | 37/248 |
| 5,022,780 | 6/1991 | Shaw | 403/275 |

FOREIGN PATENT DOCUMENTS

| | | |
|---|---|---|
| 2073727 | 10/1971 | France . |
| 2145715 | 3/1972 | Germany . |

*Primary Examiner*—Terry Lee Melius
*Assistant Examiner*—Victor Batson
*Attorney, Agent, or Firm*—Adrian D. Battison; Murray E. Thrift

[57] ABSTRACT

An apparatus for removing ice and snow from a surface consisting of a support frame and a elongate member rotatably mounted on the support frame. The elongate member has a first end and a second end. A plurality of flexible arms extend from the elongate member in a substantially helical pattern. Upon rotation of the elongate member the arms violently strike a ground surface to dislodge packed snow and ice which is then carried by the helical pattern of the arms from the first end of the elongate member toward the second end.

17 Claims, 5 Drawing Sheets

APPARATUS FOR REMOVING SCRAPING A GROUND SURFACE

BACKGROUND OF THE INVENTION

The present invention relates to an apparatus for scraping a ground surface for example for removing snow and ice from a surface such as a roadway, sidewalk, airport runway or the like.

There are a number of apparatus used for removing snow and ice from sidewalks, roadways and airport runways. Ideally these apparatus should leave a surface entirely clear of ice and snow. In some applications, in particular airport runways, injury or death can result from a poorly cleaned surface.

One apparatus currently available is an auger which has a horizontal rotating shaft with a flight welded onto the shaft and rotated therewith. The auger normally forms part of a snow blower with a fan arrangement which ejects the snow collected by the auger to an remote location. Augers are effective for removing large accumulations of snow, but the flight engaging the ground is incapable of leaving a surface entirely clear of ice and snow. Scraper blades are also effective for removing large accumulations of snow, and can if operated on a flat surface with sufficient care be used to scrape the surface relatively bare. However the scraper blade causes damage to curbs, manhole covers, and the like when an attempt is made to use the scraper blade to leave a surface entirely clear of ice and snow. Sweepers are also available which are not normally used for ice and snow as they have relatively soft brushes of wire or nylon which are capable of removing a light covering of snow from a surface without causing damage. Sweepers are, however, incapable of removing large quantities of snow or small quantities of packed snow, and ice from a surface. A sweeper cannot even remove its own tracks. Sweepers also cannot operate in certain snow conditions. For example, freezing slush can adhere to the sweepers bristles and cause the sweeper to run out of balance. The sweeper can only operate for a limited period in an unbalanced condition before mechanical problems occur.

SUMMARY OF THE INVENTION

What is required is a more versatile apparatus for removing ice and snow which is capable of leaving a surface substantially free of ice and snow regardless of the snow and ice conditions.

According to the present invention there is provided an apparatus for removing ice and snow from a surface which is comprised of a support frame and a elongate member rotatably mounted on the support frame. The elongate member has a first end and a second end, A plurality of flexible arms extend from the elongate member. Drive means are provided for high speed rotation of the elongate member such that the arms violently strike a ground surface to dislodge packed snow and ice.

Although beneficial results may be obtained through the use of the apparatus as described, the apparatus will tend to push the snow ahead in the fashion of a sweeper. Even more beneficial results may be obtained when the flexible arms are arranged in a substantially helical pattern. When arranged in a substantially helical pattern, the rapidly rotating flexible arms function as an auger to carry ice and snow from the first end of the elongate member toward the second end.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
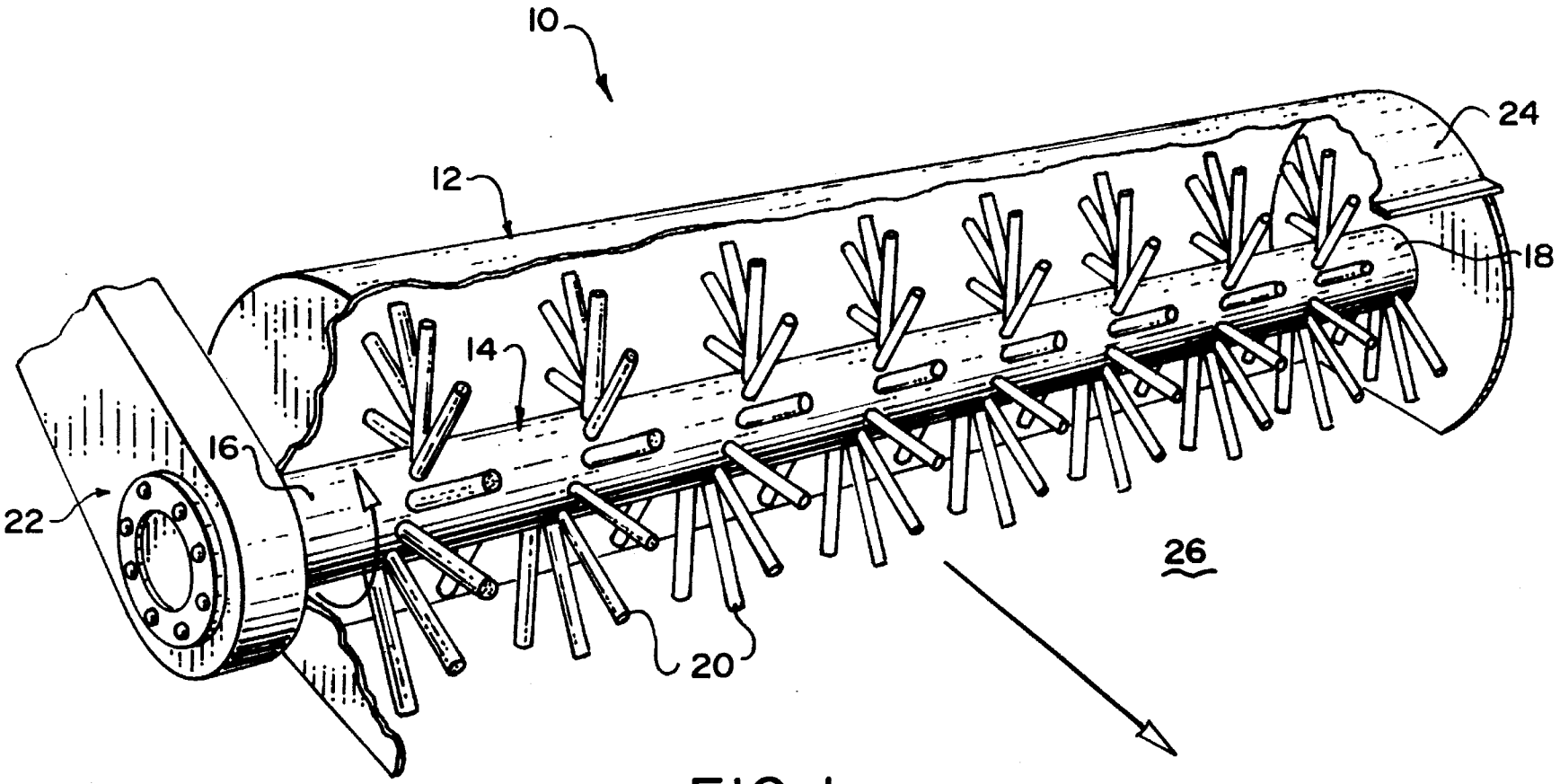
FIG. 1 is a perspective view of an apparatus for removing snow and ice from a surface constructed in accordance with the teachings of the present invention.

Apparatus 10 consists of a support frame 12 and an elongate cylindrical member 14 rotatably mounted on support frame 12. Elongate member 14 has a first end 16 and a second end 18. A plurality of flexible arms 20 extend from elongate member 14 in a substantially helical pattern. It is preferred that flexible arms 20 can be constructed of a heavy gauge 1 inch diameter steel cable. A main drive unit 22 is provided at first end 16 of elongate member 14 to serve as drive means for high speed rotation of the elongate member 14. A protective shield 24 is secured to support frame 12 and partially shields elongate member 14.

The use and operation of apparatus 10 will now be described with reference to FIG. 1. For the purpose of the description a ground surface will be identified by reference numeral 26. Apparatus 10 is intended to be mounted on a suitable propulsion system for example a truck, self-propelled machine a wheeled trailer or other form of motor vehicle. Main drive unit 22 rotates elongate member 14 at high speed such that arms 20 violently strike ground surface 26 to dislodge packed snow and ice. The debris of ice and snow is then carried by the helical pattern of arms 20 from first end 16 of elongate member 14 toward second end 18. Protective shield 24 confines the ice and snow to protect persons in the area from being harmed by flying debris. It has been found that arms 20 are effective regardless of the snow and ice conditions. However, apparatus 10 has proven to be particularly effective in removing ice, and for this reason apparatus 10 is well suited for cleaning airport runways. Over prolonged use the steel cables, out of which arms 20 are constructed, tend to flair at their remote ends. This flaring does not diminish the effectiveness of arms 20, and may actually marginally increase their effectiveness.

Figure 5:
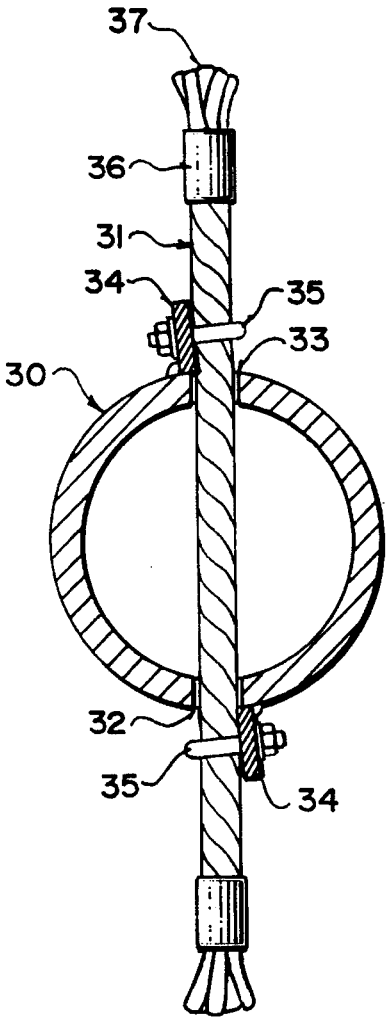
FIG. 5 is a vertical cross sectional view through the cylindrical member showing one of the transverse cables forming the flexible arms.

Turning now to FIGS. 2, 3, 4 and 5, more detail of the cylindrical member and the flexible arms are shown over and beyond the schematic arrangement shown in FIG. 1. Thus in FIG. 5 is shown a cross section of the cylindrical member which comprises a tubular body formed of metal and indicated at 30. Two of the flexible arms are formed by a single transverse cable 31 which extends through holes 32 and 33 in the tubular body generally at diametrically opposed positions. On the outside surface of the tubular body is welded at each hole a support plate 34 which lies adjacent an edge of the hole and extends generally radially outwardly from the outside surface. The cable 31 is clamped to the plates 34 by U-clamps 35 which pass through holes in the plate 34 and are bolted thereto on a rear side of the plate. The plate is inclined slightly away from the axis of the hole since the clamping action tends to bend the cable slightly and it is desired that the cable extend radially outwardly from the axis of the cylindrical body 30.

The cable is of the multi strand type including a plurality of cabled bundles of wires with each bundle including a plurality of twisted wires. The cable is of the type conventionally used for heavy duty pulling and may have a diameter of the order of 0.75 to 1.5 inch so that the cable is extremely stiff. At a position spaced outwardly from the surface of the cylindrical body and also spaced inwardly from the outer edge of the cable is provided a collar 36 which is swaged onto the cable so as to squeeze the material of the collar into the interstices between the wires of the cable. This acts to permanently attach the collar to the cable thus clamping the cable at that position. The end of The cable is cut at right angles to the length of the cable to define an outer cut end 37 at which the wires can be splayed either by a splaying action or simply during operation of the device in engagement with the ground. The collar however limits the splaying of the wires so that this cannot extend beyond the outer end of the metal collar 36.

Figure 2:
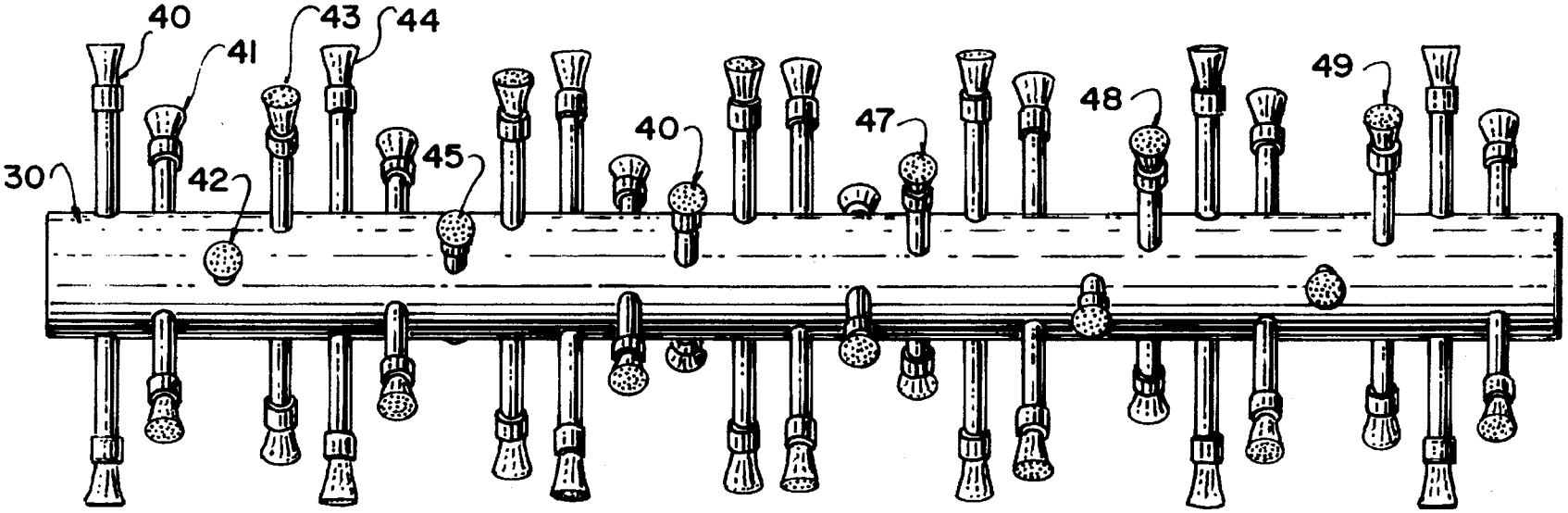
FIG. 2 is a front elevational view of the rotating cylindrical member of FIG. 1 showing more detail.
Figures 3, 4:
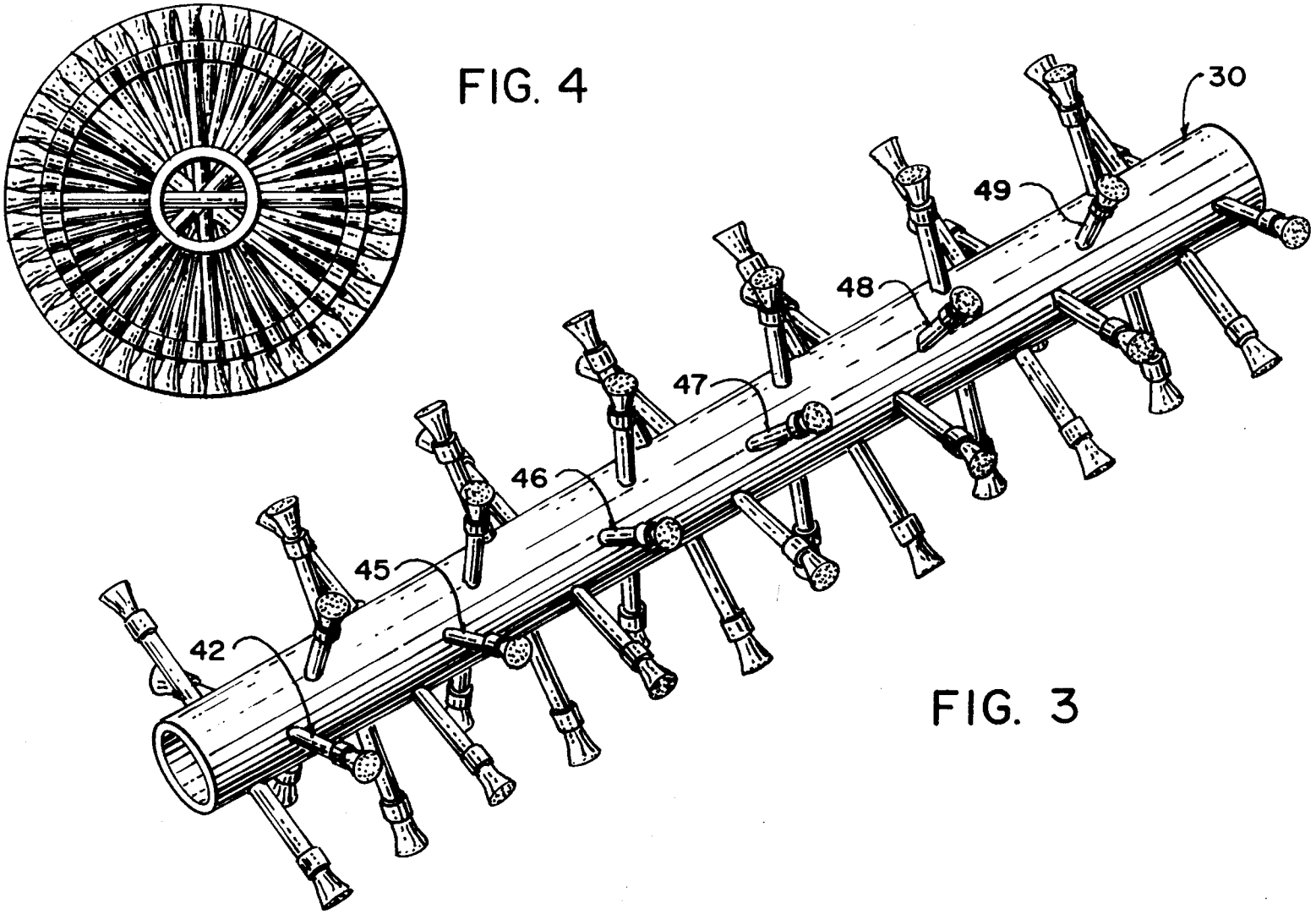
FIG. 3 is an isometric view of the cylindrical member of FIG. 2.
FIG. 4 is an end elevational view of the cylindrical member of FIG. 2.

The arrangement of the cables on the drum or cylindrical body is shown in FIGS. 2, 3 and 4. These figures are shown schematically for convenience of illustration and to show simply the arrangement of the cables. Thus as shown in FIGS. 2 and 3, commencing at the left hand end of the cylindrical body 30, a first cable 40 passes through the body 30 substantially diametrically at a first axial location. A second cable 41 is rotated about the axis by an angle a little greater than 45°. A third cable 42 is rotated relative to the second by an angle slightly greater than 45° so that the total angle between the first and the third is just greater than 90°. The fourth indicated at 43 is rotated again through an angle just greater than 45° to the third. The fifth indicated at 44 is rotated again through the same angle relative to the fourth so that the total angle between the first and fifth is slightly greater than 180°. This ensures that the first and the fifth do not lie along the same axial line. This effect is best shown in FIG. 2 as indicated by the cables 42, 45, 46, 47, 48 and 49. The same cables are shown in FIG. 3 and it will be seen that these lie along a slow helix extending from one end of the cylindrical to the opposed end. The effect of this slow helix is that, as the body rotates about its axis, the cables of the row do not simultaneously contact the ground but instead engage the ground sequentially. This avoids violent increases in the amount of force applied to the drive system. This arrangement of the cables is shown in FIG. 4 where it will be seen that the cables are graduated around the full periphery thus maintaining the drive force relatively constant since the cables contact the ground sequentially rather than a number contacting simultaneously.

In addition to the slow helical shape formed by every fifth one of the cables, there is in addition a second helix defined by the cables taken sequentially. This sharper angle helix acts in the manner of an auger tending to sweep the materials to one end of the rotating body.

The primary working part of the machine is therefore the power driven sweeping drum. This drum is mounted on a power vehicle such as a tractor or on a towed implement frame. The support may be constructed so that it is partially counterbalanced by mechanical springs, gas operated springs, hydraulic accumulator or similar balancing system. The drum is assisted in moving up when the drum encounters an obstacle that is fixed or is too large or too heavy too move. This will reduce damage to the device and to structures such as curbs and walkways.

The drum maybe driven by a variety of power transmission systems. This would include conventional mechanical mechanisms such as drive shafts, gear boxes, roller chains and universal joints. It may be protected from excessive driving torque by a slip clutch, shear pin or other torque limiting device. The mechanical drive may use an overrunning clutch to protect it from damage if the power is suddenly stopped. The drum could also be driven by a hydraulic pump or motor or other power transmission system. The most suitable power transmission system can be selected depending upon the prime power source, the required drive geometry and the power required for the particular application.

The drum consists of a tubular center supported on conventional bearings mounted on shafts projecting out of each end of the drum. The drive is transmitted to one of the end shafts.

The frayed end of the wire cable has sufficient flexibility so that when it comes in contact with the paved surface it does not cause excessive damage. The frayed end of the wire rope or cable also increases the width of pavement surface that the wire cable contacts with each pass. This helps ensure that all of the paved surface is properly covered during the sweeping action.

The portion of the cable which is prevented from fraying ensures that there is sufficient resistance to bending in the cable to break up ice surfaces and convey ice or other objects to the side.

Figure 6:
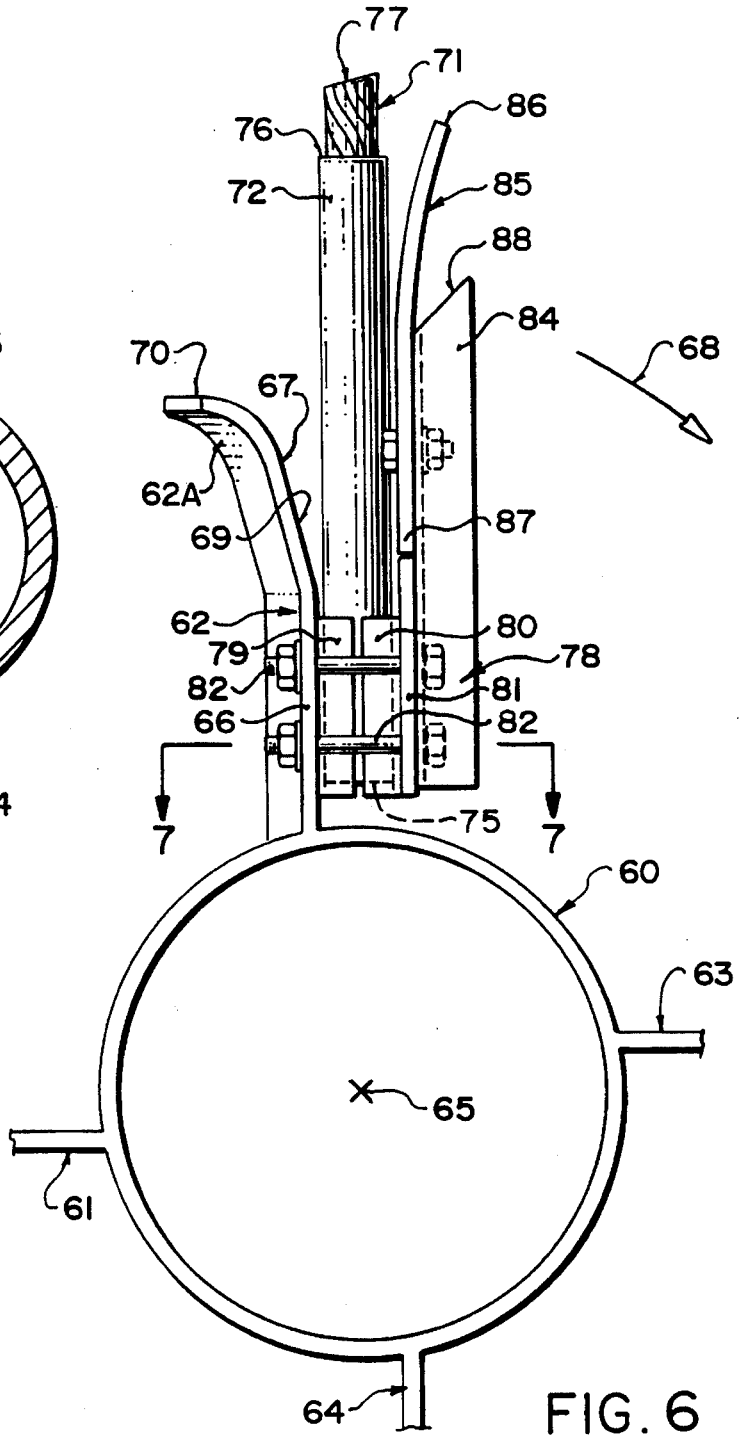
FIG. 6 is a cross-sectional view through a further embodiment of the invention showing particularly the mounting of the cable on the support drum.
Figure 7:
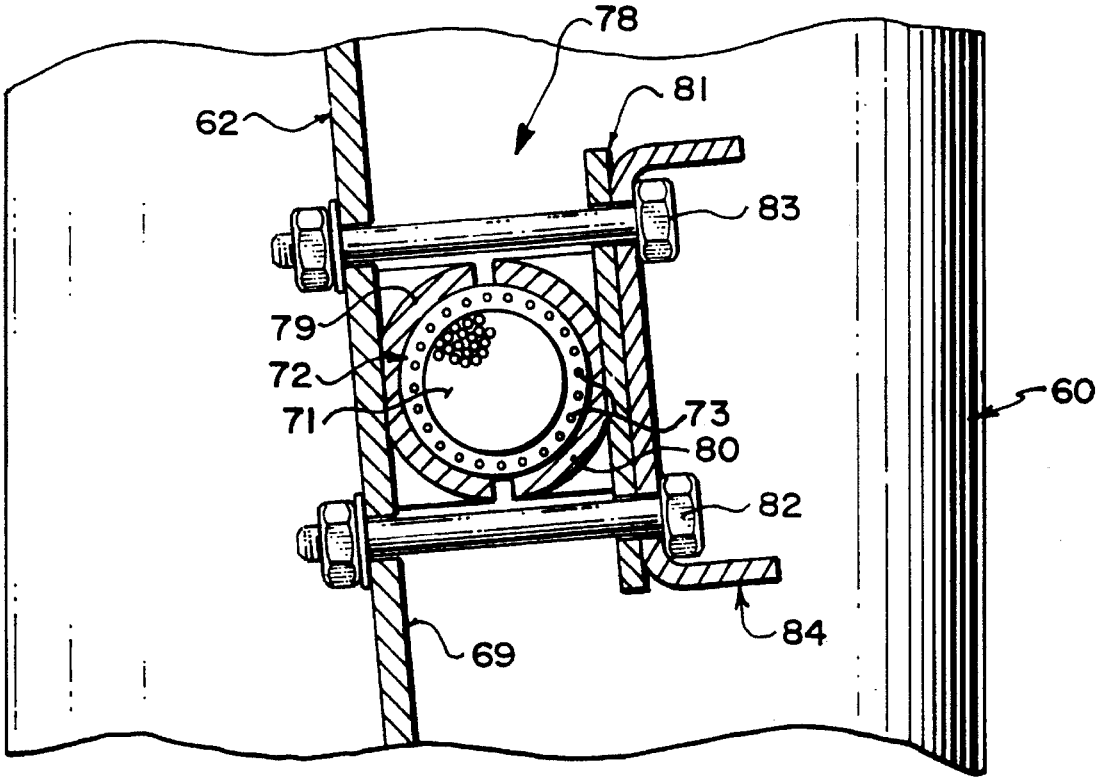
FIG. 7 is a cross-sectional view along the lines 7–7 of FIG. 6 showing for convenience only one of the cables.
Figure 8:
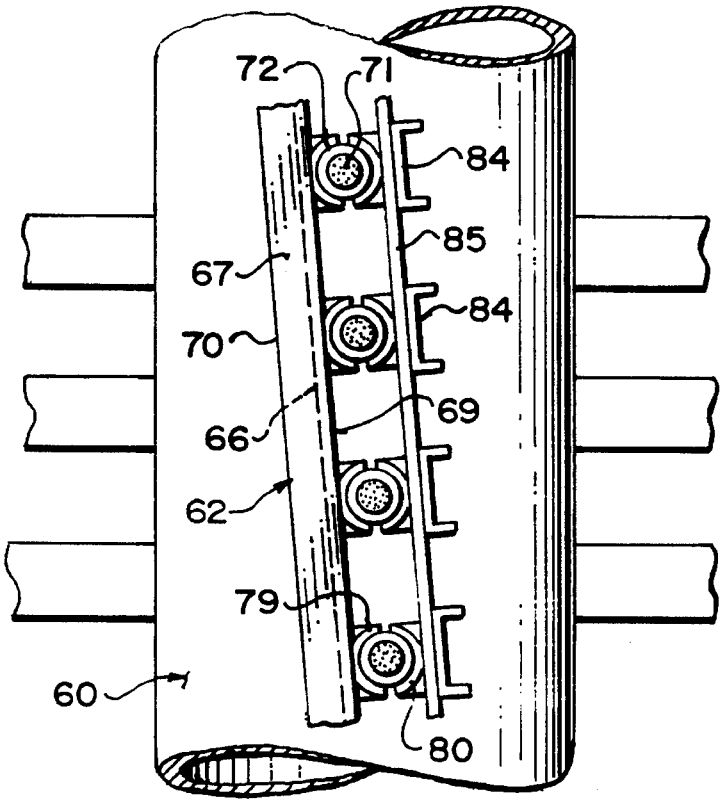
FIG. 8 is a top plan view of the embodiment of FIG. 6.

Turning now to FIG. 6 there is shown an alternative construction for the mourning of the cables on the support or drum indicated at 60. For convenience of illustration only a single one of the cables is shown. On the drum is mounted four mounting plates 61, 62, 63 and 64 arranged at 90°. Each plate extends longitudinally of the drum 60 along the full length of the drum. Each plate extends substantially radially from the drum relative to a central axis 65 of the drum. However each plate is arranged at a slight angle to the drum so that it extends around the drum in a slight or slow helix as visible at 62A. Each plate includes a first portion 66 which extends substantially radially directly outwardly from the drum and a second portion 67 which is at a slight angle to the first portion 66 so as to be inclined outwardly and rearwardly relative to a direction of rotation of the drum as is indicated schematically at 68. The plate thus has a front surface 69 facing forwardly of the direction of rotation. An outermost end 70 of the plate is curved rearwardly to form a smoothly curved portion of the forward surface 69.

The cable is indicated at 71 and is formed of the construction previously described but in this embodiment is surrounded by a sleeve 72 formed of a flexible hose of a rubber material reinforced with fibers 73. A suitable hose can be provided by a conventional hydraulic hose of the required diameter so that it is a tight fit around the outer surface of the cable 71. The sleeve or hose 72 extends from a lower end 75 of the cable to an upper end 76 of the sleeve which is spaced inwardly of an outer end 77 of the cable. This leaves a portion of the order of 1 to 2 inches of the cable which is exposed at the outer end for engaging the ground in the sweeping action as previously described.

The cable and the sleeve surrounding the cable are attached to the portion 66 of the plate 62 by a clamping system generally indicated at 78. The clamping system includes a pair of clamp blocks 79 and 80 each surrounding a portion of the cable at the lower end 75 thereof. The clamp block 79 includes a front face thereof lying in engagement with the surface 69 of the plate 62. The clamp block 80 carries a flange 81 at its end opposite the plate 62. The flange 81 and the plate 62 include four cooperating holes for receiving two pairs of bolts 82 and 83 each on a respective side of the cable. A channel member 84 is clamped to the outer surface of the flange 81 by the same bolts 82 and 83 which pass through holes in the base web of the channel member, through the flange 81, across the space between the flange 81 and the plate 62, through the plate 62 to nuts provided on the rear face of the plate 62. The channel member is thus rigidly clamped to the plate 62 and the channel member stands upwardly from the flange 81 which terminates at the height of the clamping block 80 so that the channel member 84 extends upwardly to at least a height of the upper edge of the portion 67 of the plate 62 and preferably beyond that to a position adjacent but spaced inwardly from the upper end of the cable and the upper end 76 of the sleeve 72. On a rear face of each of the channel members 84 as best shown in FIG. 6 is provided a flap member 85 which extends along the full length of the support body 60. The flap member is formed of a flap of flexible materials such as rubber which has an upper end 86 adjacent to the end 77 of the cable and beyond the end 76 of the sleeve. The flap 85 extends inwardly from its outer end 86 to an inner end 87 adjacent the blocks 80 the flap 85 thus forms in effect an elongate flexible blade extending substantially along the full length of the support roller 60. The flap being formed of flexible rubber material can flex over the upper end 88 of the channel members 84 with that upper end being chamfered upwardly and forwardly to accommodate the flexing movement of the flap.

As best shown in FIG. 6, the cables are clamped at spaced positions along the length of the plate, each having its own channel member 84 and clamping blocks 79 and 80. The plate 62 extends along the full length so that it engages a plurality of the cables and similarly the flap 85 extends along the full length so that it engages a plurality of the cables and associated clamping channel members 84.

The cables attached to the plate 64 which is opposite to the plate 62 are directly aligned in common axial planes with the cables of the plate 62. The cables on the other plates 61 and 63 are spaced in between the cables of the plates 62 and 64. In this way a full surface of the ground is swept with each axial position on the ground being swept twice firstly by one cable and then a cable arranged at 180° spacing around the drum. The slight helical arrangement of the plates ensures that the cables do not simultaneously engage the ground at specific angular locations around the drum but instead the engagement with the ground is graduated.

In operation the flap 85 acts as a blade to a high degree of air flow around the support roller 60 in the form of a large fan. This air flow effects sweeping movement of the mass of the ice and snow while the cable engages the ground and breaks up any layer of ice engaged on the ground.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An apparatus for scraping a ground surface, comprising; a support frame; a hub member rotatably mounted on the support frame for rotation about a substantially horizontal axis; drive means for driving the rotation of the hub member in a direction of rotation; a plurality of flexible arms mounted on the hub member at angularly spaced positions around the axis for rotation therewith, the arms extending substantially radially from the axis such that an outer end of each arm can effect engagement with the ground surface in a scraping action; and a flexible flap member mounted on the hub member so as to extend outwardly therefrom substantially in an axial plane of the hub member and alongside at least one of the flexible arms.

2. The apparatus according to claim 1 wherein the flap member extends longitudinally along at least a part of the length of the hub member so as to engage a plurality of the flexible arms at spaced positions along the hub member.

3. The apparatus according to claim 2 wherein the flexible flap member is arranged on a forward side of the arms relative to the direction of rotation.

4. The apparatus according to claim 1 wherein each flexible arm comprises a multi-strand hardened steel, solid core wire cable.

5. The apparatus according to claim 4 wherein the cable comprises a plurality of cabled bundles, each bundle having a plurality of twisted strands of wire.

6. The apparatus according to claim 1 wherein the flexible arms are arranged in rows with each row defining a slow helix around the axis of the hub member.

7. The apparatus according to claim 6 wherein adjacent ones of the flexible arms are arranged in a second helix at a greater angle than the slow helix of the rows.

8. The apparatus according to claim 1 wherein each flexible arm comprises a multi-strand wire cable having a surrounding flexible sleeve engaged thereon tightly around an outer surface of the cable to hold the wires of the cable within the sleeve, the surrounding sleeve having an outer end spaced inwardly from an outer end of the cable such that the outer end of the cable is exposed from the sleeve as it engages the ground in the scraping action.

9. The apparatus according to claim 1 including a plurality of rigid support plates mounted on the hub member at angularly spaced positions therearound so as to extend substantially radially outwardly therefrom, each plate including a first portion extending substantially radially outwardly from the hub member to which at least a respective one of the flexible arms is clamped, with the plate rearward of the respective arm relative to the direction of rotation, and a second portion outward of the first portion inclined outwardly and rearwardly relative to the direction of rotation of the hub member.

10. The apparatus according to claim 9 wherein the flap member is on an opposite side of the flexible arm to the plate.

11. The apparatus according to claim 1 wherein the flap member is supported by a plurality of substantially radially extending rigid support elements extending outward from the hub member, each being arranged adjacent a respective one of the flexible arms.

12. An apparatus for scraping a ground surface, comprising; a support frame; a hub member rotatably mounted on the support frame for rotation about a substantially horizontal axis; drive means for driving the rotation of the hub member in a direction of rotation; a plurality of flexible arms mounted on the hub member at angularly spaced positions around the axis for rotation therewith, the arms extending substantially radially from the axis such that an outer end of each arm can effect engagement with the ground surface in a scraping action; and a plurality of rigid support plates mounted on the hub member at angularly spaced positions therearound so as to extend substantially radially outwardly therefrom, each plate including a first portion extending substantially radially outwardly from the hub member to which at least a respective one of the flexible arms is clamped and a second portion outward of the first portion inclined outwardly and rearwardly relative to the direction of rotation of the hub member.

13. The apparatus according to claim 12 wherein each flexible arm comprises a multi-strand hardened steel, solid core wire cable.

14. The apparatus according to claim 13 wherein the cable comprises a plurality of cabled bundles, each bundle having a plurality of twisted strands of wire.

15. The apparatus according to claim 12 wherein the flexible arms are arranged in rows with each row defining a slow helix around the axis of the hub member.

16. The apparatus according to claim 15 wherein adjacent ones of the flexible arms are arranged in a second helix at a greater angle than the slow helix of the rows.

17. The apparatus according to claim 12 wherein each flexible arm comprises a multi-strand wire cable having a surrounding flexible sleeve engaged thereon tightly around an outer surface of the cable to hold the wires of the cable within the sleeve, the surrounding sleeve having an outer end spaced inwardly from an outer end of the cable such that the outer end of the cable is exposed from the sleeve as it engages the ground in the scraping action.

* * * * *